US011318370B2

(12) United States Patent
Guenzani

(10) Patent No.: US 11,318,370 B2
(45) Date of Patent: May 3, 2022

(54) YOSHIMOTO CUBE AND POLYHEDRON

(71) Applicant: R.E.F. GUENZANI S.R.L., Gallarate (IT)

(72) Inventor: Filippo Guenzani, Gallarate (IT)

( * ) Notice: Subject to any disclaimer, the term of this patent is extended or adjusted under 35 U.S.C. 154(b) by 0 days.

(21) Appl. No.: 17/258,612

(22) PCT Filed: Jan. 30, 2020

(86) PCT No.: PCT/IB2019/056058
§ 371 (c)(1),
(2) Date: Jan. 7, 2021

(87) PCT Pub. No.: WO2020/021384
PCT Pub. Date: Jan. 30, 2020

(65) Prior Publication Data
US 2021/0275904 A1 Sep. 9, 2021

(51) Int. Cl.
*A63F 9/12* (2006.01)
*A63F 9/08* (2006.01)

(52) U.S. Cl.
CPC ..... *A63F 9/1208* (2013.01); *A63F 9/088* (2013.01); *A63F 2009/1224* (2013.01)

(58) Field of Classification Search
CPC ... A63F 9/12; A63F 2009/1224; A63F 9/1208
See application file for complete search history.

(56) References Cited

U.S. PATENT DOCUMENTS 3,201,894 A * 8/1965 Resch ..... A63F 9/088 446/487
3,496,670 A * 2/1970 Ryan ..... A63H 33/088 446/104

(Continued)

FOREIGN PATENT DOCUMENTS

EP 0069188 A1 * 1/1983 ..... A63H 33/04
EP 2138209 A1 * 12/2009 ..... A63F 9/088

(Continued)

OTHER PUBLICATIONS

"MoMA Design Store", <https://store.moma.org/kids/toys-games/yoshimoto-cube-no.-1/67866-67866.html>, retrieved on Sep. 27, 2021. (Year: 2021).*

(Continued)

*Primary Examiner* — Steven B Wong
(74) *Attorney, Agent, or Firm* — Patshegan IP LLC; Moshe Pinchas

(57) ABSTRACT

A polyhedron (100) configured to be removably coupled by shape with another polyhedron (200) to form a Yoshimoto cube (1), such polyhedron (100) comprising: eight half-cubes (101, 102) equal to each other, each of which being delimited by three outer faces (1011, 1012, 1013), having a substantially square configuration, arranged orthogonally to each other whereby each outer face (1011, 1012, 1013) is delimited by two edges (10111, 10112) in common with the other outer faces (1012, 1013) and two free edges (10113, 10114), and by 6 inner faces (1014, 1015, 1016, 1017, 1018, 1019), having a substantially triangular configuration, wherein each inner face (1014, 1015, 1016, 1017, 1018, 1019) extends between a vertex (V), in common with the other inner faces of the half-cube (101), substantially coinciding with the geometric centre of a cube delimited by said three outer faces (1011, 1012, 1013), and a respective base, corresponding to a free edge (10113) between two free edges of one of said outer faces (1011, 1012, 1013); and eight hinge members (300), each configured to connect a free edge (10113, 10113') of each half-cube (101, 101') with a free edge (10113', 10113) of another half-cube (101', 101) adjacent thereto, wherein each hinge member (300) comprises at least one axis of rotation (301) around which the two half-cubes (101,101') connected by such hinge member (Continued)

(300) may mutually move; characterized in that each hinge member (300) of such polyhedron (100): extends along each of the two free edges (10113, 10113') of the two respective adjacent half-cubes (101, 101') connected by the hinge member (300), starting from a same end of each free edge (10113, 10113') of the two free edges and for an overall length lower than the length of each free edge (10113, 10113'), optionally substantially other than or equal to half the length of each free edge (10113, 10113'), defines an axis of rotation (301) parallel to each free edge (10113, 10113'), and allows a mutual angular movement between the two respective adjacent half-cubes (101, 101') connected by it, comprised between a first configuration, wherein the outer faces delimited by the respective free edges (10113, 10113'), at which the connection with the hinge member (300) is made, match, and the corresponding portions of the respective free edges (10113, 10113') which are not connected by the hinge member (300) delimit a first housing seat (3021), configured to support a possible corresponding hinge member (400) of the other polyhedron (200); and a second configuration, wherein the outer faces delimited by the respective free edges at which the connection is made are thereby arranged along a same plane, spaced apart from each other, and thus delimit, between the respective free edges at which the connection with the hinge member (300) is made, a second housing seat (3022) configured to house, substantially to size, a possible corresponding hinge member (400) of the other polyhedron (200).

10 Claims, 5 Drawing Sheets

(56) References Cited

U.S. PATENT DOCUMENTS

| | | | | | |
|---|---|---|---|---|---|
| 3,596,396 | A * | 8/1971 | Thomson | A63F 9/088 | 446/487 |
| 3,662,486 | A * | 5/1972 | Freedman | A63H 33/065 | 446/120 |
| 4,323,244 | A * | 4/1982 | Busing | A63F 9/12 | 156/73.1 |
| 4,633,607 | A * | 1/1987 | Brasch | G09F 1/06 | 40/530 |
| 4,875,681 | A * | 10/1989 | Ofir | A63F 9/088 | 273/155 |
| 5,322,284 | A * | 6/1994 | El-Agamawi | A63F 9/088 | 273/157 R |
| 5,538,452 | A * | 7/1996 | Kurani | A63F 9/088 | 446/102 |
| 5,630,587 | A * | 5/1997 | Zlotsky | A63F 9/088 | 273/155 |
| 6,712,358 | B1 | 3/2004 | Dimitriou | | |
| 8,393,623 | B2 * | 3/2013 | Storer | A63F 9/088 | 273/156 |
| 2011/0101609 | A1 | 5/2011 | Storer | | |
| 2012/0049448 | A1 * | 3/2012 | Agamawi | A63F 9/0876 | 273/153 S |
| 2012/0049449 | A1 | 3/2012 | Agamawi | | |

FOREIGN PATENT DOCUMENTS

| | | | | |
|---|---|---|---|---|
| GB | 1376733 | A * | 12/1974 | A63F 9/088 |
| JP | 3218370 | B2 * | 10/2001 | A63F 9/088 |
| KR | 20090006648 | A * | 1/2009 | A63F 9/088 |
| WO | 2014/094051 | A1 | 6/2014 | |

OTHER PUBLICATIONS

"Imaginary Open Mathematics: Yoshimoto Shorts", <https://www.imaginary.org/film/yoshimoto-shorts>, retrieved on Sep. 27, 2021. (Year: 2013).*

"Yoshimoto Cube Puzzle: BeatTheBush", <https://www.youtube.com/watch?v-mM7jt5a8TE0>, retrieved on Sep. 27, 2021. (Year: 2015).*

ISR; European Patent Office; NL; Dec. 10, 2019.

* cited by examiner

SEZIONE A-A

YOSHIMOTO CUBE AND POLYHEDRON

The present invention relates to a mechanical toy, and more specifically a polyhedron configured to be included in an improved Yoshimoto cube, as well as an improved Yoshimoto cube.

As is known, a Yoshimoto cube is a polyhedral mechanical toy or puzzle, invented in 1971 by Naoki Yoshimoto, who developed three different versions thereof. One in particular, the Yoshimoto cube No. 1, included in the permanent collection of the Museum of Modern Art in New York in 1982, includes two polyhedra configured to be removably coupled together in a complementary manner to form a single body capable of taking different configurations, including a cube.

The peculiarity of the two polyhedra of the Yoshimoto cube, which are identical to each other, is that each polyhedron is comprised of eight components shaped as half-cubes, connected to each other in an articulated manner, whereby each polyhedron can take different configurations, including two extended configurations, each forming a substantially planar surface (in which the two extended configurations are complementary with respect to one another), a star-shaped configuration and a cube-shaped configuration.

In the above-mentioned Yoshimoto cube, the half-cubes of each polyhedron are connected in an articulated manner by means of a flexible film, e.g., made of transparent plastic material, applied between the outer faces of two adjacent half-cubes in such a way that the respective connection edges, i.e., the edges at which the articulated connection between the two half-cubes is made, each delimiting an outer face of a half-cube, are thereby set alongside one another.

Applying the transparent film to connect to each other the half-cubes of each polyhedron allows, with minimal overall dimensions, to couple two adjacent half-cubes so that they may mutually move by rotating around a common axis of rotation, substantially coinciding with the respective connection edges.

However, if on the one hand using such a flexible film to have the half-cubes connected minimizes the overall dimensions, on the other hand it entails a number of disadvantages, including the easiness of wear and tear and the fact that, in certain configurations, the outer faces of the half-cubes delimited by the respective connection edges, mutually moving by rotating around the common axis of rotation, are unable to get closer to each other until they match. This causes that, in some of the above-mentioned configurations of each polyhedron, as well as of the Yoshimoto cube consisting of the coupling of the two polyhedra, unintended gaps can be formed between the faces and/or edges of the half-cubes, such unintended gaps, although small in size, giving each polyhedron or the Yoshimoto cube which they form an irregular and aesthetically unpleasant appearance.

To solve this drawback, in a simplified version of the Yoshimoto cube, consisting of a single polyhedron comprising eight cubes connected to each other in an articulated manner, connecting hinges have been used between pairs of adjacent cubes, each of which extends parallel to the respective connection edges, i.e., parallel to the edges of the cubes at which the articulated connection is made, protruding with respect to the overall dimensions of each cube and for a length substantially corresponding to that of the connection edges. Such a type of hinge is configured in such a way that two cubes hinged together can mutually move by rotating around a common axis of rotation, parallel and not coinciding with the respective connection edges, allowing the outer faces of the two hinged cubes, delimited by the respective connection edges, to match without forming unintended empty spaces, when they are brought closer to each other.

Although the solution adopted for the simplified Yoshimoto cube solves the above-described drawbacks, since it provides a wear-resistant connection method which at the same time reduces the unwanted gaps between the edges and the faces of the cubes composing it, it cannot be applied to the original Yoshimoto cube, comprising two polyhedra configured to be removably coupled together in a complementary manner, since the hinge protruding with respect to the overall dimensions of the half-cubes connected by it hinders the complementary coupling of the two polyhedra, to form a single body.

Therefore, the need is felt to provide an alternative solution which allows to solve the aforementioned drawbacks.

More specifically, it is an object of the present invention to provide a polyhedron configured to be removably coupled by shape to another polyhedron to form an improved Yoshimoto cube, wherein each polyhedron can take different configurations without leaving unintended empty spaces between its faces and/or edges.

Another object of the present invention is to provide an improved Yoshimoto cube, wherein the two polyhedra composing it are able to easily couple to each other in a complementary manner to form a single body, without leaving unintended spaces between their faces and/or edges.

A further object of the present invention is to provide a polyhedron configured to be removably coupled by shape to another polyhedron to form a Yoshimoto cube, as well as an improved Yoshimoto cube, which are easy to make and cost-effective.

These and yet other objects of the present invention are achieved by a polyhedron, configured to be removably coupled by shape to another polyhedron to form a Yoshimoto cube according to claim 1, and an improved Yoshimoto cube according to claim 10. Preferred embodiments of the present invention are defined in the dependent claims.

The present invention will now be described, by way of non-limiting illustration, according to preferred embodiments thereof, with particular reference to the Figures of the appended drawings, wherein.

In the attached Figures, the same reference numbers will be used for like elements.

Figure 1:
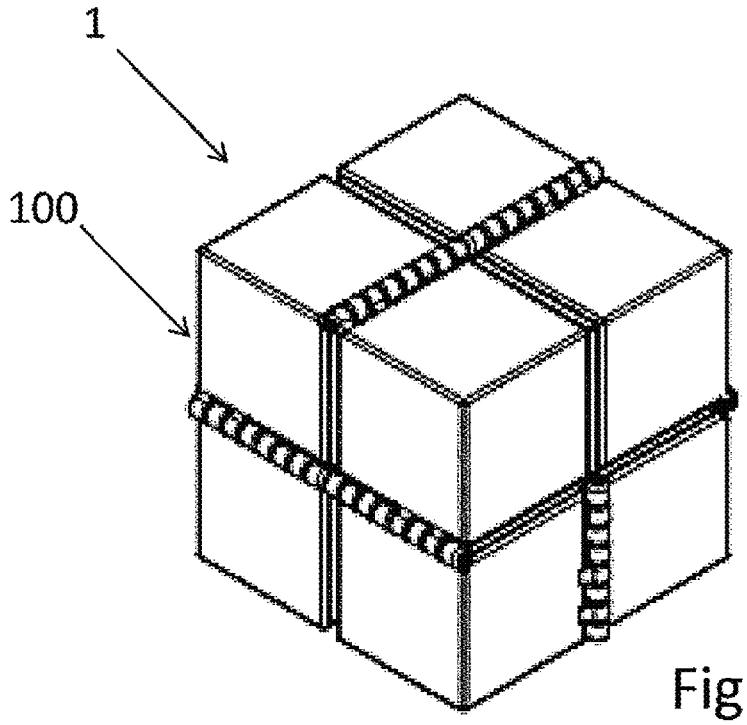
FIG. 1 shows a perspective side elevation view of a Yoshimoto cube according to the present invention, in a coupling configuration of the two polyhedra composing it.
Figure 2:
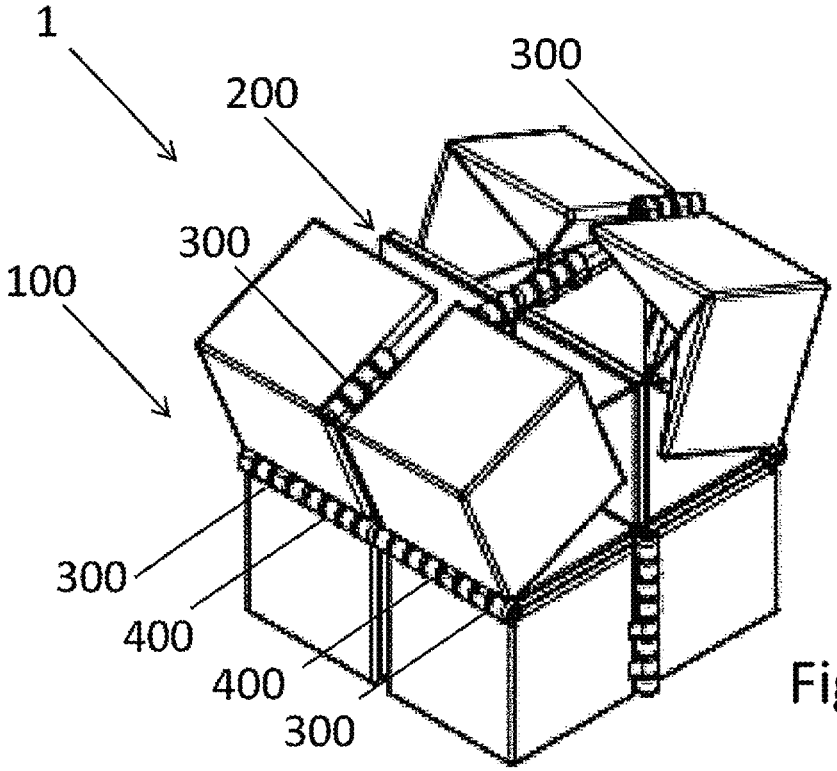
FIG. 2 is a perspective side elevation view of the Yoshimoto cube in FIG. 1, in an intermediate configuration between a coupling configuration and a decoupling configuration of the two polyhedra composing it.

Before going into the description of the invention, it is specified that a polyhedron subject-matter of the invention, configured to be removably coupled by shape to another polyhedron to form the improved Yoshimoto cube, can be traded and used both alone and paired with another polyhedron having substantially the same configuration, or a different one as to a detail element which will be indicated in the following, therefore in the following description, for convenience, unless it is strictly necessary, reference will be made mainly to a single polyhedron and the reference numbers indicated in the description will be mainly those of this polyhedron, it being understood that what is described with reference to it also applies to the other polyhedron, unless it is expressly specified otherwise, and that the references of both polyhedra will be mentioned, where needed, in relation to their removable coupling in shape, for the formation of a single body.

It is also specified, with reference to the appended Figures, that a polyhedron according to the present invention, configured to be coupled by shape to another polyhedron to form a single body, including an improved Yoshimoto cube (cube which in the appended figures is generically indicated by the reference number 1), is indicated in the appended drawings with the reference 100 or 200.

The polyhedron 100 and the second polyhedron 200 each include eight half-cubes, indicated by the references 101 or 201 (FIG. 3), which are all equal to each other.

Each half-cube of the eight half-cubes—for the sake of convenience reference is made, for example, to a half-cube 101 of the polyhedron 100—is delimited by:

- three outer faces (see, in particular, FIG. 4, wherein the outer faces are indicated by the references 1011, 1012, 1013), having a substantially square configuration, arranged orthogonally to each other, whereby each outer face (e.g., 1011) is thereby delimited by two edges (10111, 10112) in common with the other outer faces of the half-cube (1012, 1013) and two free edges (10113 and 10114), and
- from 6 inner faces (1014, 1015, 1016, 1017, 1018, 1019), having a substantially triangular configuration, wherein each inner face (see, for example, 1014) extends between a vertex V, in common with the other inner faces of the half-cube 101, substantially coinciding with the geometric centre of a cube delimited by the three outer faces (1011, 1012, and 1013), and a respective base, corresponding to a free edge (which for the inner face 1014 is indicated by the reference number 10133) of the two free edges of one of such outer faces (which for the inner face 1014 is the free edge 10133 of the outer face 1013).

Figure 3:
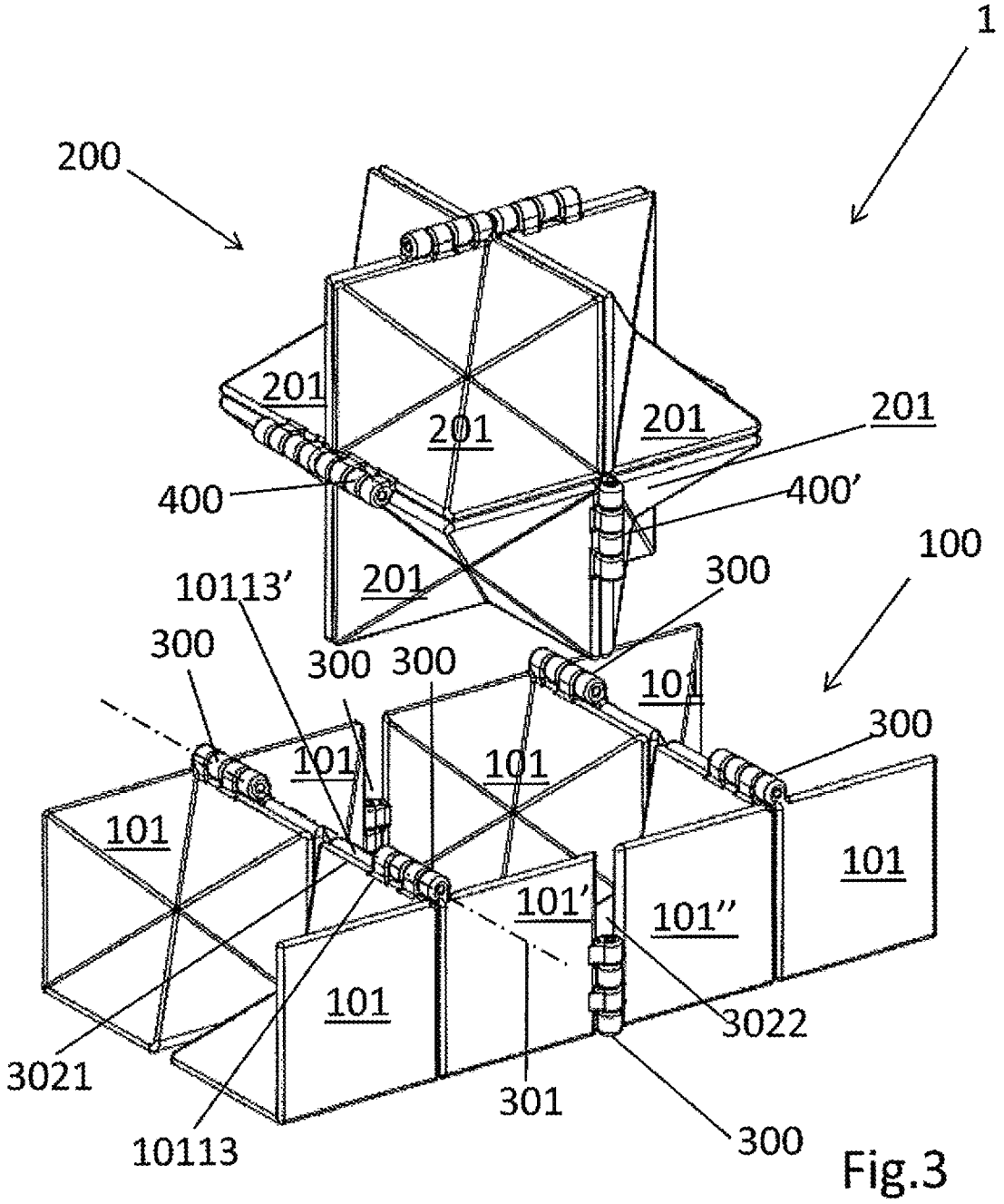
FIG. 3 illustrates a perspective side elevation view of the Yoshimoto cube in FIG. 1, in a decoupling configuration wherein the two polyhedra composing it are physically separated from each other, and one takes a star-shaped configuration, while the other takes a configuration forming a substantially planar concave surface.
Figure 4:
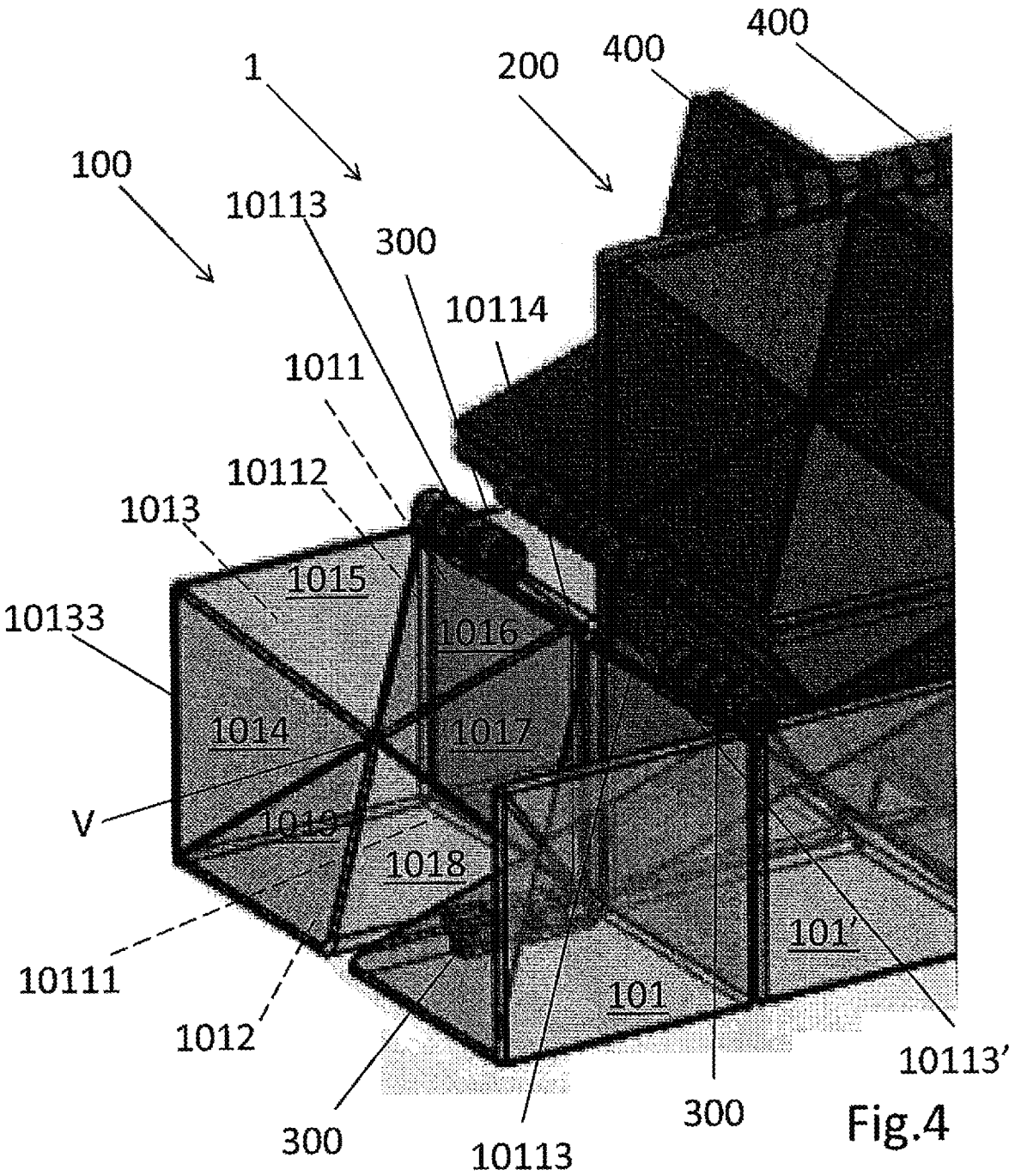
FIG. 4 shows a partial perspective side elevation view, with see-through parts, of the Yoshimoto cube, in a decoupling configuration of the two polyhedra wherein, as in FIG. 3, the two polyhedra are physically separated from each other, and one takes a star-shaped configuration, while the other takes a configuration forming a substantially planar concave surface.

Each polyhedron (for the sake of simplicity, reference will be made again to polyhedron 100) further comprises eight hinge members, those visible in the Figures being indicated by the references 300, each configured to connect one of the free edges (for example 10113 in FIG. 3) of an own first half-cube 101 with another of the free edges of an own second half-cube adjacent thereto (e.g., the free edge 10113' of the half-cube 101' shown in FIGS. 3 and 4, to facilitate understanding of the text).

Each hinge member 300 defines at least one axis of rotation 301 around which the first half-cube 101 and the second half-cube 101', connected by means of the hinge member 300, can rotate to mutually move.

More specifically, as can be seen from FIGS. 3, 4, 5, and 6, each hinge member 300 (for the polyhedron 100, wherein it connects a first half-cube 101 with a second half-cube 101'):

- extends along each of the two free edges 10113 and 10113' of the two respective adjacent half-cubes 101, 101' connected by the hinge member 300, starting from a same end of each free edge 10113 or 10113', and for an overall length lower than the length of this free edge 10113 or 10113', optionally substantially other than or equal to half the length of such free edge 10113 or 10113',
- defines an axis of rotation 301 parallel to each of such two free edges 10113 and 10113', and
- allows a mutual angular movement between the two respective adjacent half-cubes 101 and 101' connected by it, comprised between a first configuration, wherein:
  - the outer faces delimited by the respective free edges 10113 and 10113', at which the connection with the hinge member 300 is made, match (i.e., they face and substantially touch each other), and
  - the corresponding portions of the respective free edges 10113 and 10113' which are not connected to the hinge member 300 delimit a first housing seat 3021, configured to support a possible corresponding hinge member 400 of the other polyhedron 200, which in the illustrated case takes the star-shaped configuration (see, in particular, FIG. 3),
- and a second configuration, wherein (see FIG. 3 with reference to two adjacent half-cubes 101' and 101"):
  - the outer faces delimited by the respective free edges at which the connection is made are thereby arranged along a same plane, (slightly) spaced apart from each other, and
    1. delimit between the respective free edges at which the connection to the hinge member 300 is made, a second housing seat 3022 configured to receive, substantially to size, a possible corresponding hinge member 400 of the other polyhedron 200, which in the illustrated case takes the star-shaped configuration.

According to a preferred variant of the invention, the overall length of each hinge member 300 of a polyhedron can be lower than, or equal to, or greater than half the length of each free edge at which the connection between two half-cubes 101, 101' is made.

Figure 5:
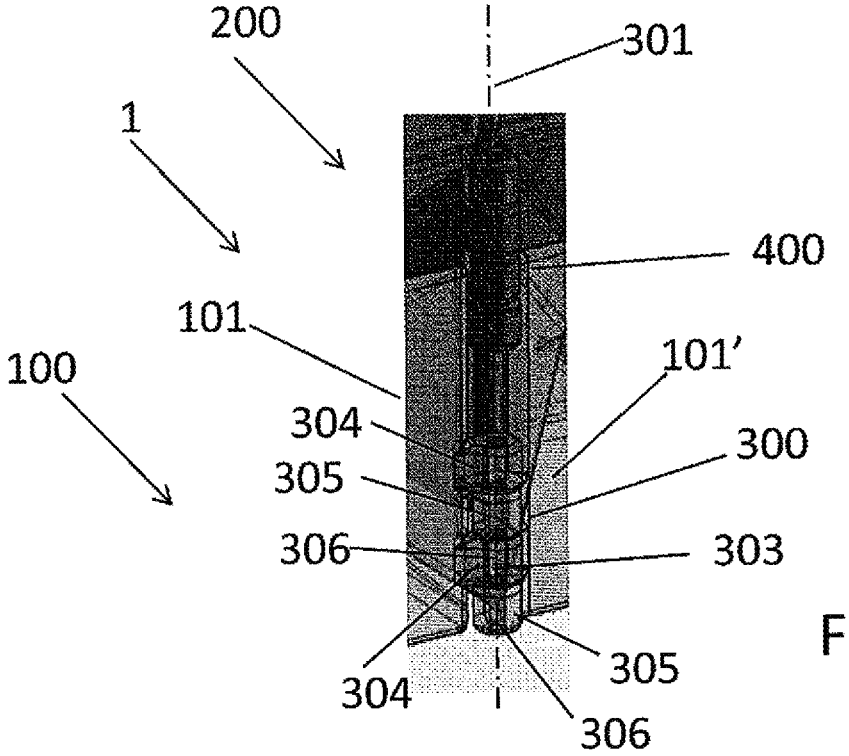
FIG. 5 is a detail, in an enlarged scale, of a connection area between the two polyhedra of the Yoshimoto cube according to the present invention.
Figure 6:
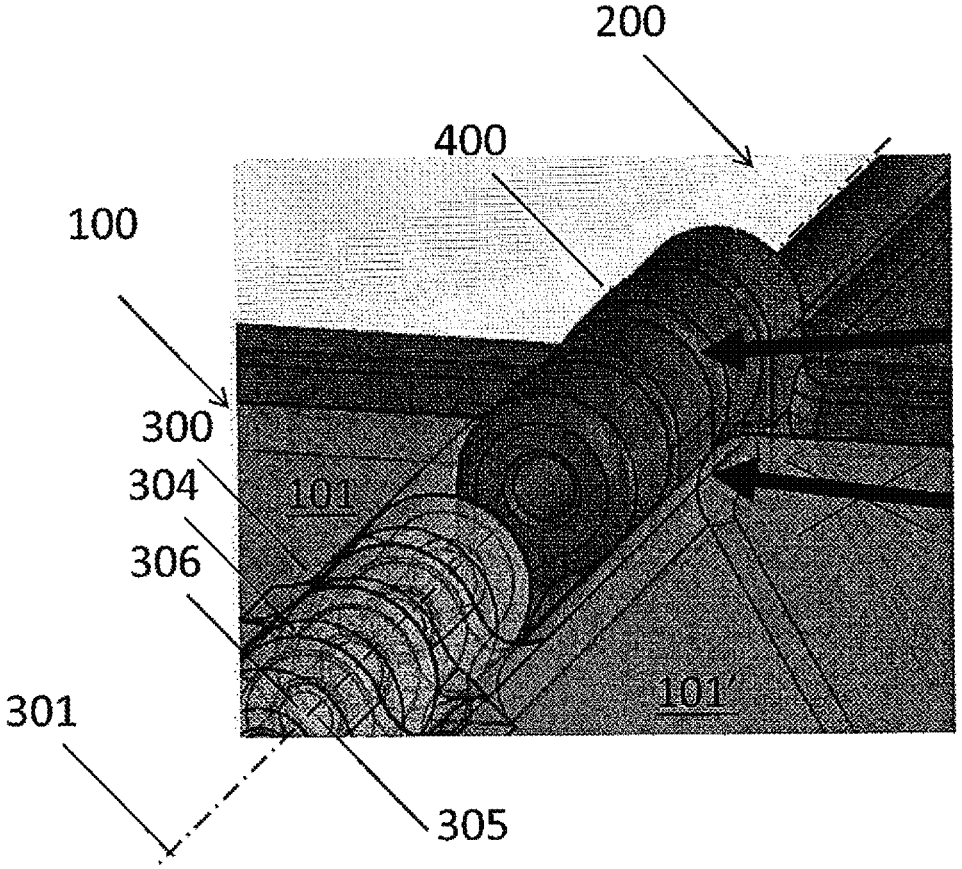
FIG. 6 illustrates another detail view, in enlarged scale, of another connection area between the two polyhedra of the Yoshimoto cube according to the present invention.

According to a first preferred variant of the present invention, each hinge member 300 comprises (refer in particular to FIGS. 5 and 6):

- at least one pin 303 (only one pin is shown in FIGS. 5 and 6),
- one or more first sleeve members 304 (in FIGS. 5 and 6 two first sleeve members 304 are shown) coupled to the free edge of a first half-cube 101 between the two adjacent half-cubes 101 and 101' connected by such a hinge member 300, and
- one or more second sleeve members 305 (in FIGS. 5 and 6 two second sleeve members 305 are shown) coupled to the free edge of a second half-cube 101' of the two adjacent half-cubes 101 and 101' connected by such hinge member 300.

The first sleeve members 304 and the second sleeve members 305 each delimit internally a through pivoting seat 306, having a size substantially corresponding to the cross-section of the pin 303, whereby when each hinge member 300 connects two adjacent half-cubes 101 and 101', the through pivoting seats 306 of the first sleeve members 304 and the through pivoting seats 306 of the second sleeve members 305 are thereby aligned with each other along the axis of rotation 301 of the hinge member 300, parallel to the respective free edges 10113 and 10113', and the pin 303 stays in place in the pivoting seats 306.

As will be noted, the first sleeve members 304 and the second sleeve members 305 can be mounted on a respective half-cube 101 and 101', or can be formed integrally with it.

Figure 7:
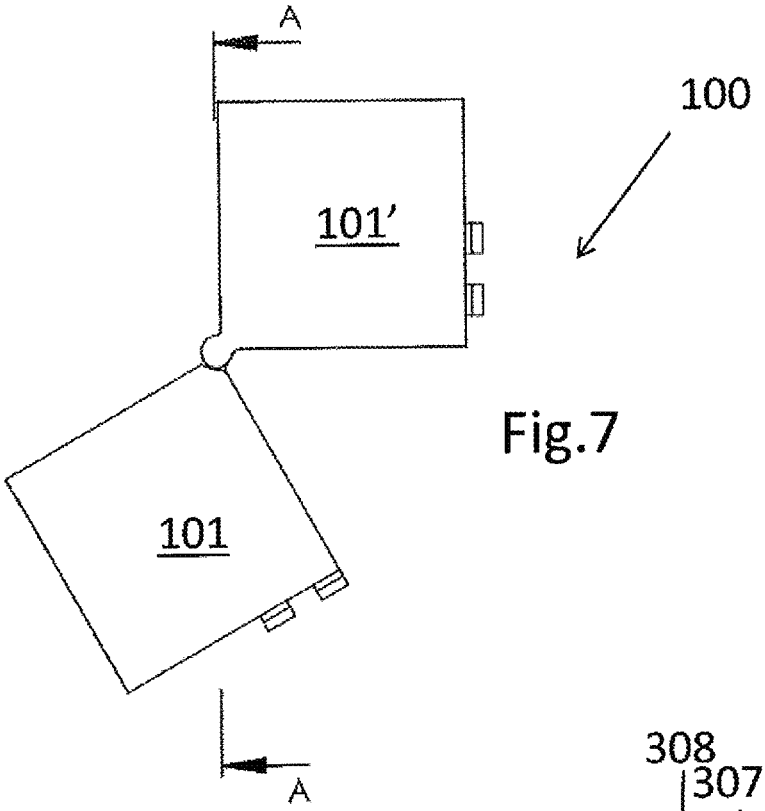
FIG. 7 shows a side view, not to scale, of a variant of the connection member between two components of a polyhedron of the Yoshimoto cube.
Figure 8:
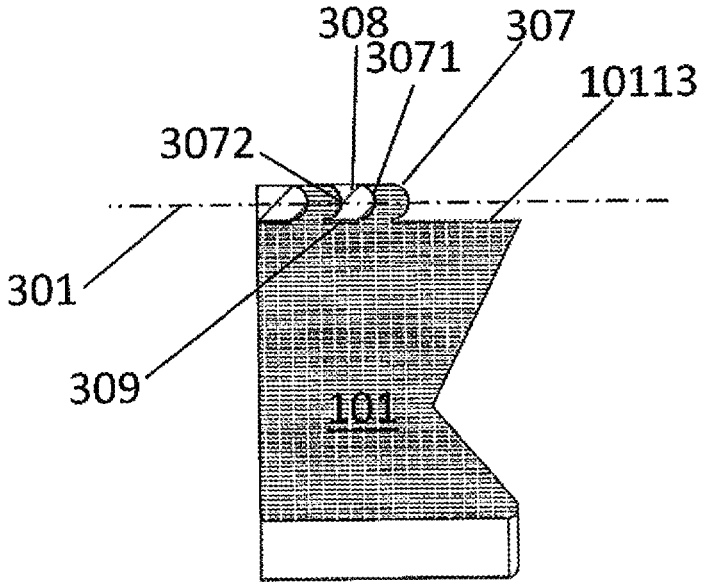
FIG. 8 is a sectional view, not to scale, taken along the section line A-A in FIG. 7.

According to a further preferred variant of the invention, each hinge member 300 can comprise (refer to the appended FIGS. 7 and 8):

at least one first transverse member 307, at the free edge 10113 of a first half-cube 101 between the two adjacent half-cubes 101 and 101' connected by such a hinge member 300, and at least one second transverse member 308, at the free edge 10113' of a second half-cube 101' between the two adjacent half-cubes 101 and 101' connected by such hinge member 300, wherein the first transverse member 307 delimits at least one rotatably interlocking housing seat 309, for the second transverse member 308, around the axis of rotation 301, so that the first half-cube 101 and the second half-cube 101' can mutually rotate around the axis of rotation 301 passing through the first transverse member 307 and the second transverse member 308.

Advantageously, the housing seat 309 has a cross-section, with respect to the axis of rotation 301, having a substantially circular configuration, and is delimited by a first transverse wall 3071 of the first transverse member 307, having a configuration which is substantially concave and symmetrical with respect to the axis of rotation 301, and by a second transverse wall 3072 of the first transverse member 307 which is substantially convex and symmetrical with respect to the axis of rotation 301, and the second transverse member 308 has a configuration corresponding to the configuration of the housing seat 309.

According to a preferred aspect of the invention, the first transverse wall 3071 and the second transverse wall 3072 have a bell-shaped and an inverted bell-shaped configuration, respectively, or vice versa.

As for the first preferred variant of the invention, the first transverse member 307 and the second transverse member 308 can be applied to the respective half-cubes 101 and 101' or can be formed integrally with them.

The above-described polyhedron can advantageously be used to be included in an improved Yoshimoto cube 1 according to the invention.

An improved Yoshimoto cube, indeed, may comprise at least one polyhedron 100 as described above, and at least one other polyhedron 200, wherein:

the other polyhedron 200 has a configuration substantially equal to that of the polyhedron 100 and the lengths of the respective hinges (which are equal between polyhedron 100 and polyhedron 200) lower or equal to half the length of the free edges 10113 and 10113', or the other polyhedron 200 differs from said polyhedron 100 in the length of its eight hinge members 400.

The coupling between the two polyhedra is made, as already mentioned above, at the first and second housing seats delimited by them, at the respective hinge members.

With reference, for example, to the polyhedron 100 (the same also holding true for the polyhedron 200), each first housing seat 3021 of the polyhedron 100 is indeed configured to support a hinge member (see, for example, the hinge member 400) of the other polyhedron 200. In this case, the first housing seat 3021 is defined by corresponding portions for housing free edges 10113 and 10113', at which a connection is made between adjacent half-cubes (specifically 101 and 101') by means of a corresponding hinge member 300, whereby these housing portions are not involved by such hinge member 300. Correspondingly, each second housing seat 3022 of the polyhedron 100, see, for example, FIG. 3, is configured to house a hinge member (see, for example, the hinge member 400') of the other polyhedron 200, when it is slidingly inserted into the second housing seat 3022 to be connected to the polyhedron 100.

So, if the other polyhedron 200 has substantially the same configuration as that of the polyhedron 100 and the length of the respective hinge members being lower than or equal to half the length of the respective free edges, a coupling by shape between the two polyhedra 100 and 200 is ensured in order to form a single body, where a Yoshimoto cube or a single body having any other configuration, without additional constraints, is desired.

By contrast, if the other polyhedron 200 has the respective hinge members having a length other than that of the polyhedron 100, if the length of the respective hinge members 300 and 400 lower than or equal to half the length of the respective free edges, a coupling by shape between the two polyhedra 100 and 200 is still ensured in order to form a single body, where a Yoshimoto cube or a single body having any other configuration, without additional constraints, is desired. Otherwise, if, for example, the length of the hinge members 300 of the polyhedron 100 is greater than half the length of its free edges, a coupling by shape between the two polyhedra 100 and 200 to form a single body, where a Yoshimoto cube or a single body having any other configuration is desired, is ensured only if the length of the hinge members of the other polyhedron 200 is lower than or equal to the difference between the length of the respective free edges (which is the same for the two polyhedra 100 and 200) and the length of each hinge member 300 of the polyhedron 100 to which the polyhedron 200 is configured to be removably coupled by shape to form a single body.

Therefore, with such a configuration, the polyhedron 100 and the other polyhedron 200 can advantageously be removably coupled to each other in a complementary manner to form a single body, with each hinge member 300 of the polyhedron 100 aligned with a corresponding hinge member 400 of the other polyhedron 200, without leaving unintended empty spaces between the faces and the edges of the respective half-cubes (101, 101', 201) of the polyhedron 100 and of the other polyhedron 200 (see, for example, FIG. 1).

The overall length of the hinge members 300 and 400 of the polyhedron 100 and of the other polyhedron 200, respectively, when they are aligned with each other, does not exceed the length of each free edge of each half-cube, whereby it does not hinder the mutual coupling between the two polyhedra 100 and 200, and allows to avoid the resulting presence of unintended empty spaces between the faces and the edges of the half-cubes 101 and 201 of the polyhedron 100 and of the other polyhedron 200.

By such a configuration of the hinge connection members 300 and 400 between the half-cubes of each of the two polyhedra 100 and 200 of the improved Yoshimoto cube 1 according to the present invention, the objects in the introduction are achieved.

Actually, since the hinge members (e.g., the members 400) of each polyhedron (e.g., of the polyhedron 200) can be housed in corresponding first housing seats (e.g., 3021) and second housing seats 3022 delimited by the other polyhedron (e.g., of the polyhedron 100), aligned with the hinge members (e.g., the members 300) of the latter along the respective free edges, the drawback of hindering the mutual coupling between polyhedra 100 and 200 is avoided, when they are removably coupled to form a single body.

At the same time, the hinge members (e.g., 300) thus configured allow two half-cubes (e.g., 101 and 101') of each polyhedron (e.g., 100), which are adjacent and connected by means of such a hinge member (300), to rotate around the common axis of rotation (301), parallel and not coinciding with the respective free connection edges 10113, allowing the outer faces of such half-cubes (101, 101') to match without creating unintended empty spaces when they are brought closer to each other.

Moreover, the above-described hinge members turn out to be surely more resistant than the film made of transparent material currently provided for the original Yoshimoto cube, whereby the Yoshimoto cube 1 according to the present invention turns out to be undoubtedly more resistant to wear than the original one.

In the foregoing, the preferred embodiments have been described, and variants of the present invention have been suggested, but it is to be understood that those skilled in the art will be able to make modifications and changes without thereby departing from the relevant scope of protection, as defined by the appended claims.

Thus, for example, the polyhedron of the present invention can be coupled to a plurality of other equal or substantially equal polyhedra, except for the length of the corresponding hinge member, to form a single body which can take different configurations. For example, a plurality of polyhedra can be assembled as described above to make a cylindrical body, e.g., a bracelet.

The invention claimed is:

1. A polyhedron configured to be removably coupled by shape with another polyhedron to form a Yoshimoto cube, said polyhedron comprising:

eight half-cubes equal to each other, each of which being delimited by three outer faces, having a substantially square configuration, arranged orthogonally to each other, whereby each outer face is delimited by two edges in common with the other outer faces and two free edges, and by 6 inner faces, having a substantially triangular configuration, wherein each inner face extends between a vertex, in common with the other inner faces of the half-cube, substantially coinciding with the geometric centre of a cube delimited by said three outer faces, and a respective base, corresponding to a free edge between two free edges of one of said outer faces; and eight hinge members, each configured to connect a free edge of each half-cube with a free edge of another half-cube adjacent thereto, wherein each hinge member (300) comprises at least one axis of rotation around which the two half-cubes connected by such hinge member can mutually move;

wherein each hinge member of said polyhedron:

extends along each of the two free edges of the two respective adjacent half-cubes connected by the hinge member, starting from a same end of each free edge of the two free edges and for an overall length lower than the length of each free edge, defines an axis of rotation parallel to each free edge and allows a mutual angular movement between the two respective adjacent half-cubes connected by it, comprised between a first configuration, wherein the outer faces delimited by the respective free edges, at which the connection with the hinge member is made, match, and the corresponding portions of the respective free edges which are not connected by the hinge member delimit a first housing seat, configured to support a corresponding hinge member of the other polyhedron; and a second configuration, wherein the outer faces delimited by the respective free edges at which the connection is made are thereby arranged along a same plane, spaced apart from each other, and thus delimit, between the respective free edges at which the connection with the hinge member is made, a second housing seat configured to house, substantially to size, a corresponding hinge member of the other polyhedron.

2. The polyhedron according to claim 1, wherein each second housing seat is configured to house a hinge member of the other polyhedron, when it is slidingly inserted into said second housing seat.

3. The polyhedron according to claim 1, wherein each hinge member comprises:

at least one pin, one or more first sleeve members, coupled to the free edge of a first half-cube between two adjacent half-cubes connected by such a hinge member, and one or more second sleeve members, coupled to the free edge of a second half-cube of the two adjacent half-cubes connected by such hinge member, the first sleeve members and the second sleeve members each delimiting internally a through pivoting seat, having a size substantially corresponding to the cross-section of said at least one pin, whereby when each hinge member connects two adjacent half-cubes, the through pivoting seats of the first sleeve member and the through pivoting seats of the second sleeve member are thereby aligned along the axis of rotation of the hinge member, parallel to the respective free edges, and the pin stays in place in the pivoting seats.

4. The cube according to claim 2, wherein the first sleeve member and the second sleeve member are mounted on a respective half-cube.

5. The polyhedron according to claim 2, wherein the first sleeve member and the second sleeve member are formed integrally with the respective half-cube.

6. The polyhedron according to claim 1, wherein each hinge member comprises:

at least one first transverse member, protruding from the free edge of a first half-cube between two adjacent half-cubes connected by such a hinge member, and at least one second transverse member protruding from the free edge of a second half-cube between the two adjacent half-cubes connected by such hinge member, wherein at least one first transverse member delimits at least one rotatably interlocking housing seat, for such at least one second transverse member, around the axis of rotation, so that the first half-cube and the second half-cube can mutually rotate around such axis of rotation passing through such at least one first transverse member and said at least one second transverse member.

7. The polyhedron according to claim 6, wherein the at least one housing seat has a cross-section, with respect to the axis of rotation, having a substantially circular configuration, and is also delimited by a first transverse wall of the first transverse member which is substantially concave and symmetrical around the axis of rotation, and by a second transverse wall of the first transverse member which is substantially convex and symmetrical around the axis of rotation, the at least one second transverse member having a configuration corresponding to the configuration of such housing seat.

8. The polyhedron according to claim 7, wherein the at least one first transverse wall and the at least one second transverse wall have a bell-shaped and an inverted bell-shaped configuration, respectively, or vice versa.

9. The polyhedron according to claim 6, wherein the at least one first transverse member and the at least one second transverse member are formed integrally with the respective half-cubes.

10. An improved Yoshimoto cube comprising at least one first polyhedron according claim 1 and at least one other polyhedron, wherein:

the other polyhedron has a configuration substantially equal to that of said first polyhedron and each hinge member of the first polyhedron has an overall length equal to that of each hinge member of the other polyhedron which is lower than or equal to half the length of each free edge, or the other polyhedron differs from said first polyhedron in the length of its eight hinge members, and each hinge member of the first polyhedron has an overall length other than that of each hinge member of the other polyhedron, which is lower than or equal to half the length of each free edge, or the other polyhedron differs from the first polyhedron in the length of its eight hinge members, and when each hinged member of the first polyhedron has an overall length other than half the length of each free edge, the length of each hinge member of the other polyhedron to which said first polyhedron is configured to be removably coupled by shape to form a Yoshimoto cube is lower than or equal to the difference between the length of the respective free edges and the length of each hinge member of the first polyhedron;

whereby the first polyhedron and the other polyhedron can be removably coupled to each other in a complementary manner to form a single body, with each hinge member of the first polyhedron aligned with a corresponding hinge member of the other polyhedron, without leaving unintended empty spaces between the faces and the edges of the respective half-cubes of the first polyhedron and of the other polyhedron.

* * * * *